US008820116B2

(12) United States Patent
Kim

(10) Patent No.: US 8,820,116 B2
(45) Date of Patent: Sep. 2, 2014

(54) ACCESSORY HAVING DECORATIVE COIN ORNAMENTS AND CONNECTORS

(71) Applicant: Yoi Sik Kim, Tongyeong-si (KR)

(72) Inventor: Yoi Sik Kim, Tongyeong-si (KR)

( * ) Notice: Subject to any disclaimer, the term of this patent is extended or adjusted under 35 U.S.C. 154(b) by 86 days.

(21) Appl. No.: 13/685,905

(22) Filed: Nov. 27, 2012

(65) Prior Publication Data

US 2014/0123701 A1 May 8, 2014

(30) Foreign Application Priority Data

May 15, 2012 (KR) ..... 10-2012-0051219

(51) Int. Cl.

| | |
|---|---|
| ***A44C 5/02*** | (2006.01) |
| ***A44C 13/00*** | (2006.01) |
| ***A44C 15/00*** | (2006.01) |
| ***A44C 21/00*** | (2006.01) |
| ***A44C 25/00*** | (2006.01) |

(52) U.S. Cl.

CPC ..... *A44C 25/00* (2013.01); *A44C 15/005* (2013.01); *A44C 21/00* (2013.01); *A44C 13/00* (2013.01)

USPC ..... 63/4; 63/9; 24/303

(58) Field of Classification Search

CPC ..... A44D 2203/00; A44C 5/107; A44C 5/00; A44C 5/02; A44C 5/105

USPC ..... 63/9, 900, 3, 3.1, 4; 24/303, 305; 59/80, 59/82; D11/3, 4

See application file for complete search history.

(56) References Cited

U.S. PATENT DOCUMENTS

| | | | | |
|---|---|---|---|---|
| 1,981,696 | A * | 11/1934 | Harper | 59/80 |
| 2,220,038 | A * | 10/1940 | Kreisler et al. | 40/725 |
| 2,521,006 | A * | 9/1950 | Hamilton | 224/196 |
| 2013/0113584 | A1 * | 5/2013 | Hunts | 335/285 |

* cited by examiner

*Primary Examiner* — Victor Batson
*Assistant Examiner* — Abigail Morrell
(74) *Attorney, Agent, or Firm* — Novick, Kim & Lee, PLLC; Jae Youn Kim

(57) ABSTRACT

An accessory having decorative coin ornaments and connectors are designed, The decorative coin ornaments can easily link each other by using the magnetic connectors. The accessories can be a necklace or a bracelet with variety of designs depending on the size and type of the coin ornaments. It could be created the various accessory fashions according to circumstances. Thereby, the wearers are able to choose their favorite accessories from the various designs. Therefore, the wearers are possibly save the money for purchasing a lot of accessories. Especially, it is providing an effect of stimulating the blood circulation of the body by using the magnetic material.

5 Claims, 7 Drawing Sheets

ACCESSORY HAVING DECORATIVE COIN ORNAMENTS AND CONNECTORS

BACKGROUND OF THE INVENTION

1. Field of the Invention

The present invention relates to an accessory including decorative coin ornaments and connectors. More specifically, the accessory includes a plurality of decorative coin ornaments and connectors, wherein the decorative coin ornaments can be easily linked together by the various connectors. The coin accessory could be used as a necklace or a bracelet. The decorative accessories could have a variety of designs, sizes, or types of coins. Thereby, the wearer can choose their favorite accessory from variety of designs. This allows the wearer to possibly save money from purchasing a lot of different accessories. The wearer can also create various accessory fashions according to their favorite. Another benefit is the effect of stimulating blood circulation of the body by adopting magnetic material.

2. Related Prior Art

In general, the accessory is a device to make the wearer looks more beautiful and elegant by attaching gold, other precious metals or jewelry on the neck or arm.

Commonly, accessories such as necklaces, bracelets and earrings are worn in direct contact to the body.

As different cultures propagate worldwide, the wearing of fascinating clothes and accessories of various designs is spreading.

Necklaces and bracelets are especially common accessories, which are worn by young teens. In other words, the common practice is to encrust ornaments with gold, silver, diamond, pearl, or other jewels that are manufactured as ready-made articles to be put on sale.

But the conventional accessories mentioned above need to have some variety so as to be in proper harmony with the wearer's clothes, hairstyle, or make-up style. In general, the wearer wears various accessories such as a necklace or a bracelet depending on what they want. In the past, the wearer had to pay a lot of money to purchase a lot of accessories.

In general, accessories are influenced by business fluctuations and fashion trends. Therefore, the wearer may not use existing accessories that are behind the current fashion trend; rather, they will buy new accessories in many cases. Accordingly, the purchasing of new accessories costs a lot.

In addition, accessories are simply worn as symbols of beauty, so their usage is limited in function.

SUMMARY OF THE INVENTION

Accordingly, it is an object of the present invention to provide an accessory having decorative coin ornaments and connectors, wherein the decorative coin ornaments and connectors can be easily connected each other. The connectors have formed an attaching structure including magnets, so that it is easy to create various designs of necklaces or bracelets according to the wearer's favorite by using various types and sizes of the coin ornaments. The wearer can easily create the accessories of various designs depending on the clothes, hairstyle, make-up style, and fashion. Thereby it is possible to remarkably reduce the purchase expenses of the expensive accessories. The accessory is comprising that; a plurality of decorative coin ornaments (100) having disk shape ornament with various sizes, a plurality of connectors (200) forming a fixing portion (210) for attaching the decorative coin ornaments ornament (100), and a connecting portion (220) for linking to the neighboring connector (200), wherein the fixing portion (210) has formed a slot (211) for inserting a coin, an upper flange (212) and a lower flange (212') formed by a clearance of inserted coin thickness, the upper flange (212) forming a screw hole (**212*a*) for inserting and fastening a fixing bolt (B), and the connecting portion (220) of the connector (200) having a magnet (221**) embedded therein.

Another object of the present invention is to provide an accessory including decorative coin ornaments and connectors, wherein the connectors have used various types of attaching structure with magnets, so that it is easy and simple to fabricate the accessory as a necklace or a bracelet, and it is adopted to use a magnet to improve health by stimulating blood circulation of the body by the magnetic field.

Accordingly, the accessory including the decorative coin ornaments and connectors mentioned above configuration, it is possible to manufacture an accessory suitable to the wearer's taste by linking various connectors to various sizes and types of decorative coin ornaments. Therefore, the wearer can easily create accessories of various designs matching to their clothes, make-up style and fashion. Thereby, it is also possible to reduce the purchasing expanse of accessories.

In addition, by configuring accessories by the connectors of the method of attaching by magnets, the wearer can decorate their appearance beautifully and can aim to improve their health as blood circulation is stimulated by the magnetic fields when the wearer wears the accessories.

DETAILED DESCRIPTION OF THE PREFERRED EMBODIMENTS

Hereinafter, the preferable embodiments of the present invention will be described with reference to the accompanying drawings.

Prior to this, terms or words used in the specification and claims should not be construed as limited to a lexical meaning, and should be understood as appropriate notions by the inventor based on that he/she is able to define terms to describe his/her invention in the best way to be seen by others. Therefore, the embodiments and drawings described herein are simply exemplary and not exhaustive, and it will be understood that various modifications and equivalents may be made to take the place of the embodiments.

Figure 1:
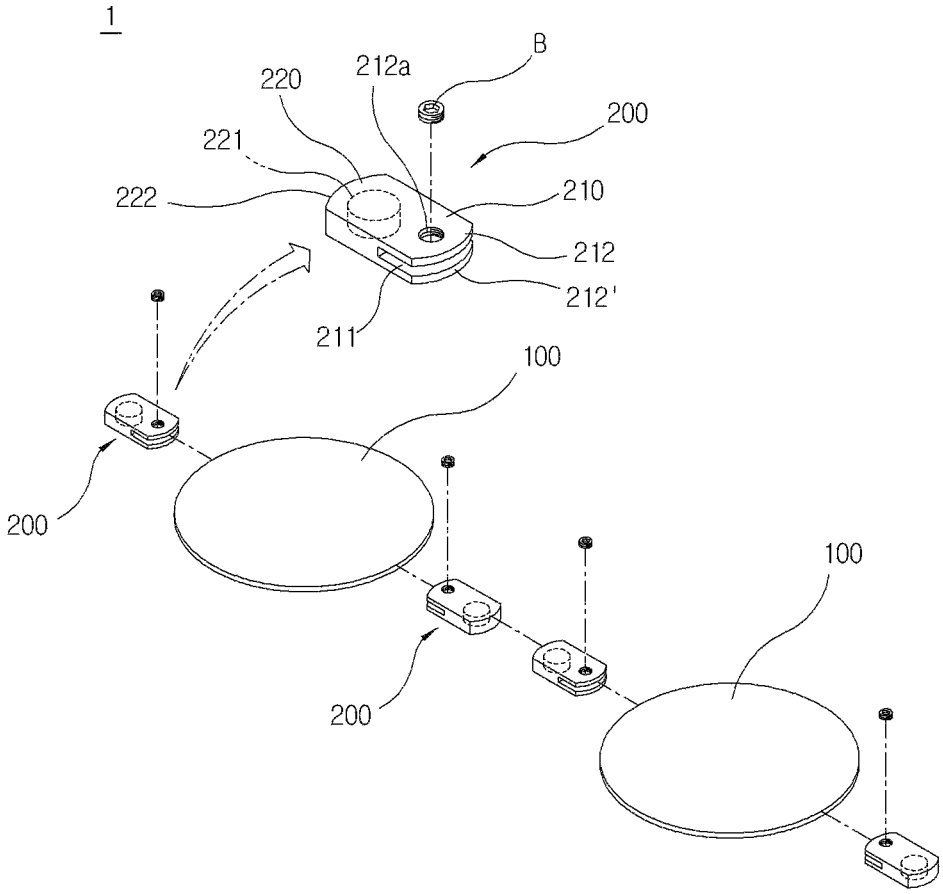
FIG. 1 is an exploded perspective view showing an accessory including decorative coin ornaments and connectors according to an embodiment of the present invention.
Figure 2:
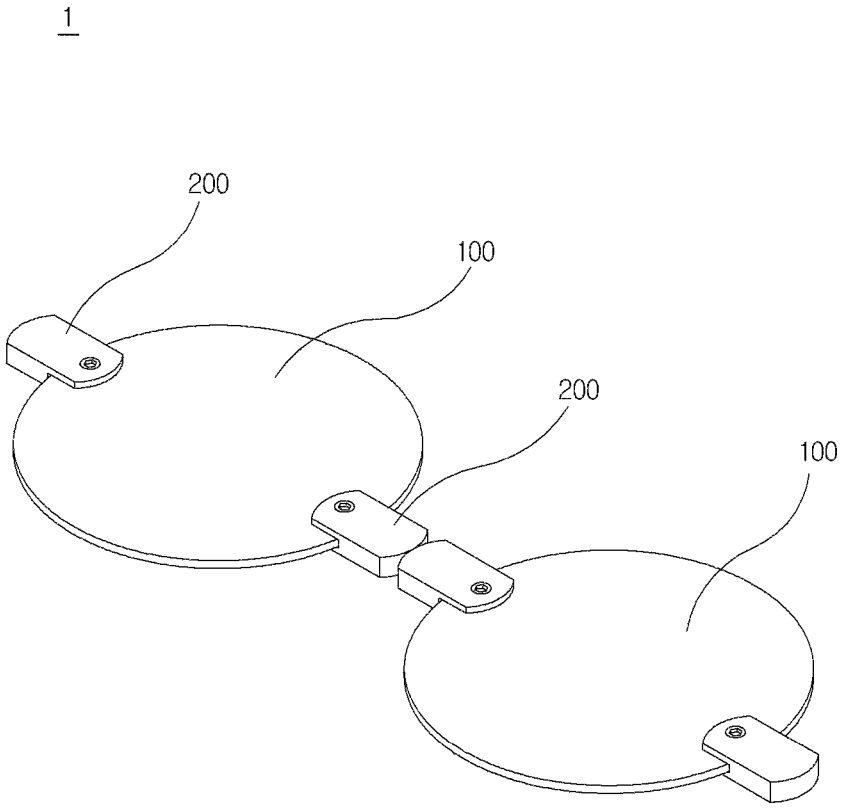
FIG. 2 is a perspective view showing the joined accessory including the decorative coin ornaments and connectors according to an embodiment of the present invention.
Figure 3:
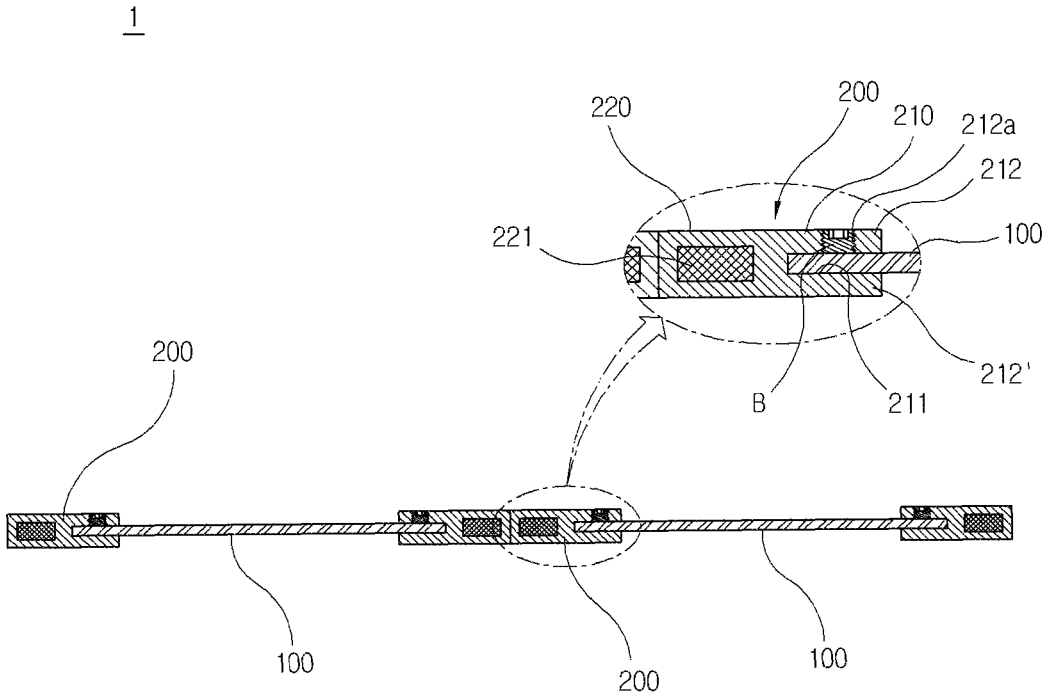
FIG. 3 is a longitudinal sectional view of the accessory including the decorative coin ornaments and connectors according to an embodiment of the present invention.
Figure 4:
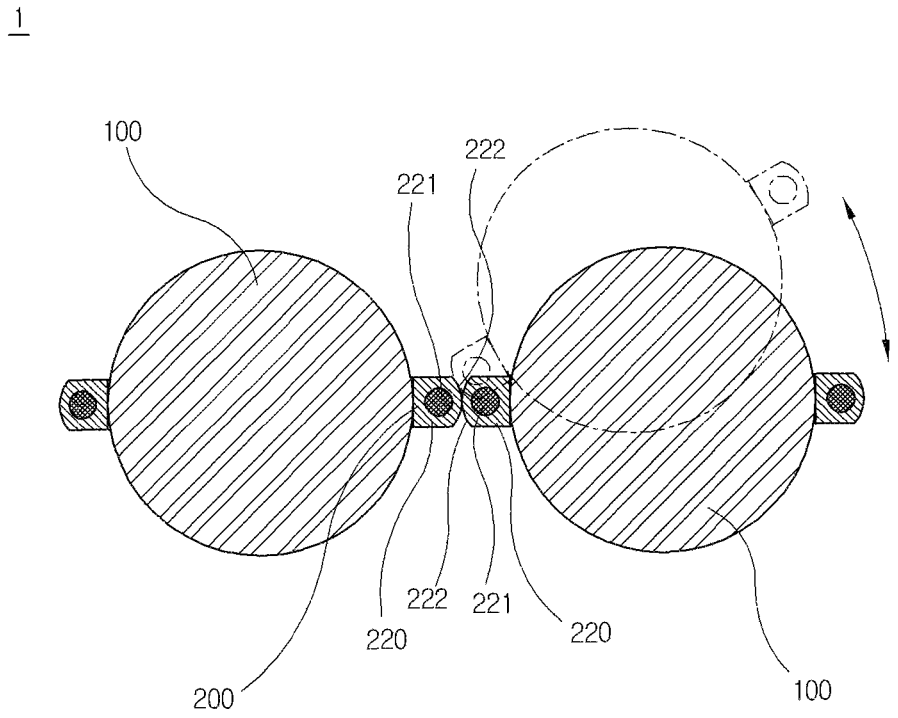
FIG. 4 is a cross sectional view of the accessory including the decorative coin ornaments and connectors according to an embodiment of the present invention.

FIG. 1 is an exploded perspective view showing an accessory including decorative coin ornaments and connectors according to the present invention, FIG. 2 is a perspective view showing the joined accessory including the decorative coin ornaments and connectors according to the present invention, FIG. 3 is a longitudinal sectional view of the accessory including the decorative coin ornaments and connectors according to the present invention, and FIG. 4 is a cross sectional view of the accessory including the decorative coin ornaments and connectors according to the present invention.

As shown in FIG. 1, a plurality of decorative coin ornaments (100) has various sizes of the disk shape ornament. A plurality of connectors (200) have formed a fixing portion (210) for attaching the decorative coin ornaments ornament (100), and a connecting portion (220) for linking to the neighboring connector (200). The fixing portion (210) has formed a slot (211) for inserting a coin, an upper flange (212) and a lower flange (212') formed by a clearance of inserted coin thickness. The upper flange (212) forms a screw hole (212*a*) for inserting and fastening a fixing bolt (B). The connecting portion (220) of the connector (200) has a magnet (221) embedded therein.

As shown in FIGS. 1 to 4, an accessory 1 including decorative coin ornaments and connectors according to the embodiment of the present invention includes a plurality of decorative coin ornaments 100 and a plurality of connectors 200 for connecting the next decorative coin ornament 100.

Here, the decorative coin ornaments 100 have disk shaped, and may be used various decorative coin ornaments 100 or commemorative coins or ornamental coins. Further, the decorative coin ornaments 100 may have various sizes and martial, the accessory 1 of the present invention is made of silver, bronze or nickel of a plurality of decorative coin ornaments 100.

In addition, the connector 200 has configured in such a way that the decorative coin ornaments 100 and neighboring decorative coin ornament 100 can be connected each other. Preferably, the connector 200 is of an elliptical shape, and has a fixing portion 210 at one end thereof and a connecting portion 220 at the other end thereof.

Here, the fixing portion 210 has a structure for fixing the decorative coin ornament 100. The fixing portion 210 has a slot 211 for inserting the decorative coin ornament 100, which is horizontally opened space in the middle along with the width-length direction. The upper and lower flanges (212, 212') have formed separately up and down by the coin insert slot 211.

At this time, a through type screw hole 212*a* for inserting a fixing bolt B is formed in the upper flange 212, and this screw hole 212*a* communicates with the coin insert slot 211. It is preferable that a conventional bolt or a wrench bolt without a bolt head being used for fixing the bolt B inserted into the screw hole 212*a*.

In addition, the connecting portion 220 formed integrally on the opposite side of the fixing portion 210 has a high-performance magnet 221 embedded therein. Therefore, as shown in FIG. 3, the fixing portion 210 of the connector 200 can be attached to the fixing portion 210 of the neighboring connector 200 by the magnet 221.

Meanwhile, as shown in FIG. 4, it is possible to variously change the angle of the coins 100 connected to left and right by configuring the end portion of the connecting portion 220 in an arc end 222 of a circular arc shape having various radii of curvature.

Figure 5:
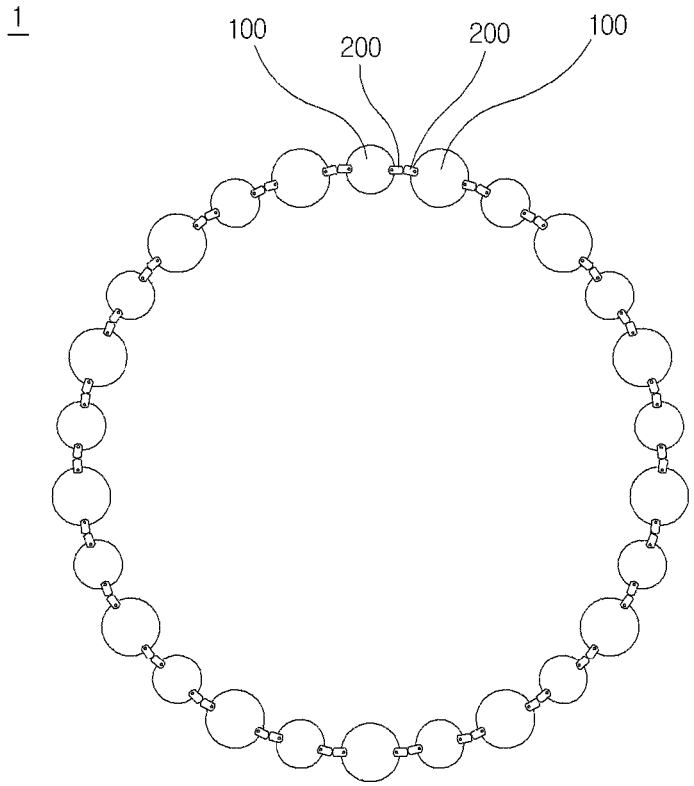
FIG. 5 is plane view showing a state that the accessory including the decorative coin ornaments and connectors according to an embodiment of the present invention is used as a necklace.
Figure 6:
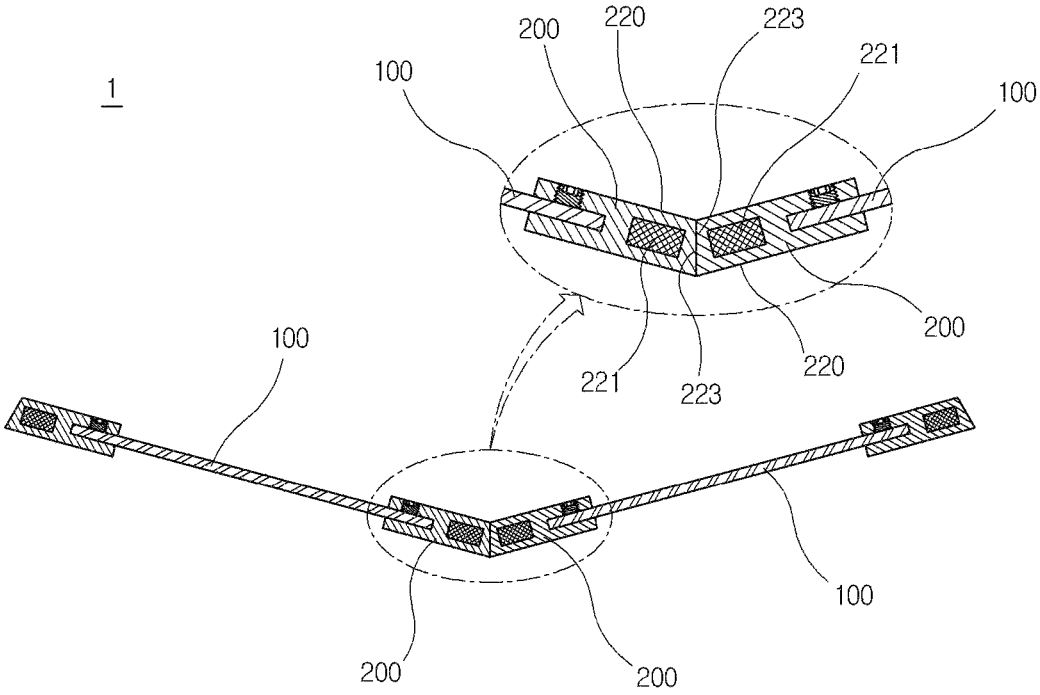
FIG. 6 is a longitudinal sectional view of an accessory including the decorative coin ornaments and connectors according to another embodiment of the present invention.

That is, as shown in FIG. 5, a plurality of decorative coin ornaments 100 can be connected by arc end 222 forming "circular ring" shape for using as a necklace. Further, as shown in FIG. 6, the end portion of the connecting portion 220 may be configured in inclined planes 223 inclined upward or downward.

One face of the decorative coin ornaments 100 may be connected by inclined planes 223 in an "angular ring" shape facing any one of center points for use as a bracelet.

Below, the operation of an accessory having the decorative coin ornaments and connectors according to the present invention will be described in detail with reference to the attached drawings.

The accessory 1 including the decorative coin ornaments and connectors according to the present invention could be a necklace or a bracelet by connecting a plurality of the decorative coin ornaments 100. For the decorative coin ornaments 100 are used here made of the nickel, bronze or copper coins, commemorative coins or ornamental coins having various sizes chosen by the wearer.

That is, the decorative coin ornaments 100 can be connected by the connectors 200 to make a necklace, bracelet or the like.

First, as shown in FIGS. 1 to 3, connectors 200 are joined to respective decorative coin ornaments 100. To connect the connector 200 to the coin 100, the fixing portion 210 is inserted to the decorative coin ornament 100 through the inserting slot 211. Then, a bolt B is inserted into the screw hole 212*a*.

That is, after inserting the circumference of the decorative coin ornament 100 into the coin insert slot 211 of the fixing portion 210, the fixing bolt B is screwed into the screw hole 212*a* formed in the upper flange 212. For fastening the fixing bolt B, press one-side of the decorative coin ornament 100 that has the front end of the bolt inserted into the coin insert slot 211. At this time, it is preferable that the fastening connectors 200 are disposed so as to face both sides of the decorative coin ornament 100.

Meanwhile, FIG. 4 illustrates an accessory 1 in which the decorative coin ornaments 100 are joined by using the connectors 200 that have a circular arc edge 222 formed in the end portion of the connecting portion 220. As shown in FIG. 4, if a connector 200 joined to the decorative coin 100 is attached to the neighboring connector 200 by the magnet 221 attaching structure, the connected decorative coin ornaments 100 can pivotally move to the left and right within a predetermined angle by the circular arc edge 222 of the connecting portion 220.

That is, if the decorative coin ornaments 100 are arranged so as to make a circle with a specific size by pivoting of the connectors 200 through the circular arc edge 222, it is possible to make an accessory 1 having a shape of a "circular ring" as shown in FIG. 5. An accessory 1 made like this can be used as a necklace, for example.

In addition, as shown in FIG. 6, if decorative coin ornaments 100 are joined by using connectors 200 that have inclined planes 223 formed in the end portion of the connecting portion 220, the connector 200 joined to the decorative coin 100 can be attached to the neighboring connector 200 by the magnet 221 attaching structure. At this time, the connected decorative coin ornaments 100 are joined in a polygon shape curved at a predetermined angle by the inclined planes 223.

Figure 7:
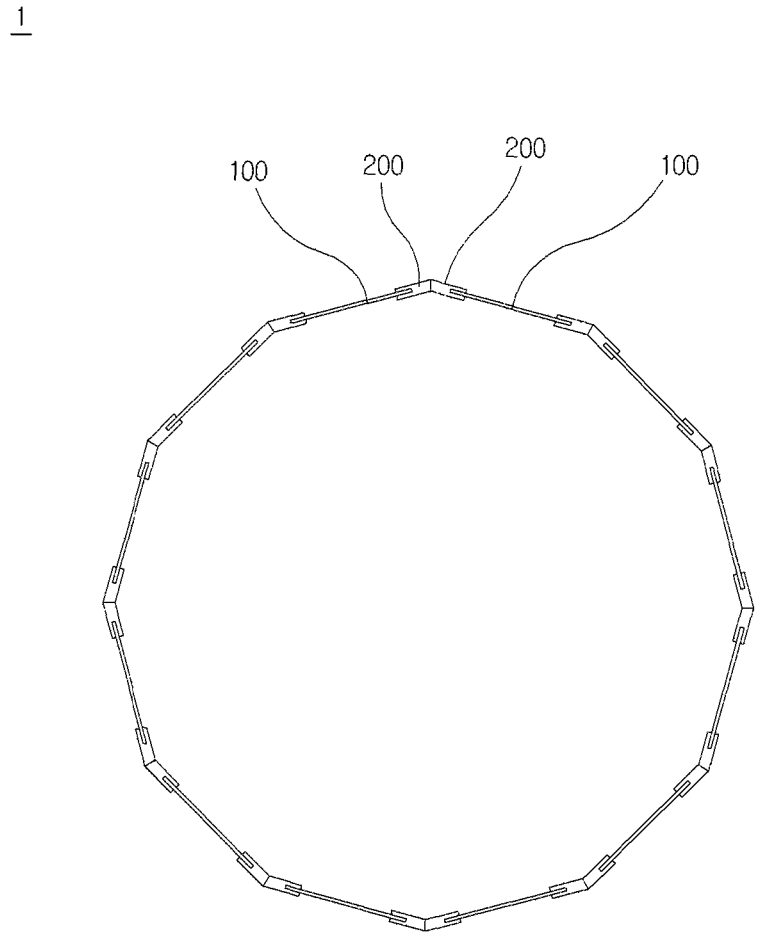
FIG. 7 is plane view showing a state that the accessory including the decorative coin ornaments and connectors according to another embodiment of the present invention is used as a bracelet.

That is, if the decorative coin ornaments 100 are connected in a row by using the inclined planes 223, the respective decorative coin ornaments 100 are connected in a polygon curved at a predetermined angle as shown in FIG. 7. At this time, the polygon formed by the accessory 1 is determined by the quantity of the coins 100. That is, connecting five coins 100 can make an accessory in the form of a pentagon, and connecting eight coins 100 can make an accessory in the form of an octagon. Further, it is also possible to make an accessory in an "angular ring" shape in which one face of the decorative coin 100 faces any one of center points. An accessory 1 made like this can also be used as a bracelet, for example.

While the present invention has been described with reference to the preferred embodiments, it will be understood by those skilled in the related art that various modifications and variations may be made therein without departing from the scope of the present invention as defined by the appended claims.

What is claimed is:

1. An accessory comprising:

a plurality of decorative coin ornaments with various sizes in a disc shape; and a plurality of connectors, each of the plurality of the connectors including a fixing portion for attaching one of the plurality of decorative coin ornaments, and a connecting portion including a magnet embedded therein, the connecting portion being attached to a neighboring connector of the plurality of the connectors by attraction force of the magnet, wherein said fixing portion has a slot defined by an upper flange and a lower flange, the slot being configured to receive an end of the one of the plurality of decorative coin ornaments, said upper flange including a screw hole for inserting and fastening a fixing bolt.

2. The accessory according to claim 1, wherein the connecting portion has an arced end including a predetermined curvature and the plurality of decorative coin ornaments are linked in a form of a circular ring shape by the plurality of connectors.

3. The accessory according to claim 1, wherein the connecting portion has a sloping plane, and the plurality of decorative coin ornaments are connected in an angular ring shape by the plurality of connectors.

4. An accessory comprising:

a plurality of decorative coin ornaments, each of the plurality of decorative coin ornaments including a first connector attached to a first end portion thereof and a second connector attached to a second end portion thereof, wherein each of the first and second connectors includes a fixing portion for attaching each of the plurality of decorative coin ornaments and a connecting portion including a magnet embedded therein, wherein the first connector includes a first slot located in the fixing portion and defined by a first upper flange and a first lower flange, the first upper flange including a first screw hole configured to receive a first screw for fixing the first connector to the first end portion, the first slot being configured to receive the first end portion of each of the plurality of coin ornaments, wherein the second connector includes a second slot located in the fixing portion and defined by a second upper flange and a second lower flange, the second upper flange including a second screw hole configured to receive a second screw for fixing the second connector to the second end portion, the second slot being configured to receive the second end portion of each of the plurality of decorative coin ornaments, wherein the first screw is in contact with a first upper surface of the first end portion to press the first upper surface so as to fix the first connector to the first end portion, and the second screw is in contact with a second upper surface of the second end portion to press the second upper surface so as to fix the second connector to the second end portion, and wherein the first connector of one of the plurality of decorative coin ornaments is attached to the second connector of another of the plurality of decorative coin ornaments by attraction force of the magnet.

5. An accessory comprising:

a plurality of decorative coin ornaments, each of the plurality of decorative coin ornaments including a first connector attached to a first end portion thereof and a second connector attached to a second end portion thereof, wherein each of the first and second connectors includes a fixing portion for attaching each of the plurality of decorative coin ornaments and a connecting portion including a magnet embedded therein, wherein the first connector includes a first slot located in the fixing portion and defined by a first upper flange and a first lower flange, the first upper flange including a first screw hole configured to receive a first screw for fixing the first connector to the first end portion, the first slot being configured to receive the first end portion of each of the plurality of coin ornaments, wherein the second connector includes a second slot located in the fixing portion and defined by a second upper flange and a second lower flange, the second upper flange including a second screw hole configured to receive a second screw for fixing the second connector to the second end portion, the second slot being configured to receive the second end portion of each of the plurality of decorative coin ornaments, wherein the first screw is in contact with a first upper surface of the first end portion to press the first upper surface so as to fix the first connector to the first end portion, and the second screw is in contact with a second upper surface of the second end portion to press the second upper surface so as to fix the second connector to the second end portion, wherein the first connector of one of the plurality of decorative coin ornaments is attached to the second connector of another of the plurality of decorative coin ornaments by attraction force of the magnet, and wherein the first connector of the one of the plurality of decorative coin ornaments includes a first sloping plane and the second connector of the another of the plurality of decorative coin ornaments includes a second sloping plane engaging with the first sloping plane, thereby creating an angle therebetween.

* * * * *